United States Patent [19]

Mitsuhashi

[11] 4,070,776

[45] Jan. 31, 1978

[54] TABLETOP DIRECTORY CASING WITH MEANS FOR READY ACCESS TO DESIRED ENTRIES

[76] Inventor: Yoshio Mitsuhashi, 79, Higashi-Kibogaoka, Asahi, Yokohama, Kanagawa, Japan

[21] Appl. No.: 719,452

[22] Filed: Sept. 1, 1976

[30] Foreign Application Priority Data

Sept. 9, 1975 Japan ..... 50-108563
Apr. 27, 1976 Japan ..... 51-47269

[51] Int. Cl.[2] ..... B42F 17/18

[52] U.S. Cl. ..... 40/381; 40/382; 40/384

[58] Field of Search ..... 40/78.15, 104.05, 78, 40/78.05, 78.11, 104.01, 68.4

[56] References Cited

U.S. PATENT DOCUMENTS

| | | | |
|---|---|---|---|
| 1,895,409 | 1/1933 | Drucker | 40/104.01 |
| 2,186,436 | 1/1940 | Shaler | 40/104.01 |
| 2,494,167 | 1/1950 | Faas | 40/104.01 |
| 2,550,598 | 4/1951 | Pollock | 40/104.01 |
| 2,573,534 | 10/1951 | Bauer | 40/104.01 |
| 3,964,192 | 6/1976 | Nonaka | 40/104.01 |

*Primary Examiner*—Russell R. Kinsey
*Assistant Examiner*—John J. Wilson
*Attorney, Agent, or Firm*—Haseltine, Lake & Waters

[57] ABSTRACT

A directory casing comprising a base supporting an unbound stack of tab-indexed cards thereon, and a top cover pivotally coupled at its rear end to the base, with the tabs of the cards projecting forwardly out of the top cover. Upon manual depression of any selected tab, the top cover opens automatically with the card or cards overlying the card having the selected tab. In the directory casing of this general character, the invention provides means for holding the stack of cards in rearwardly declining disposition on the base, whereby when any selected tab is depressed, a comparatively great spacing is formed between the card having the selected tab and the overlying card or cards, and failure-proof opening of the top cover is assured.

11 Claims, 13 Drawing Figures

TABLETOP DIRECTORY CASING WITH MEANS FOR READY ACCESS TO DESIRED ENTRIES

BACKGROUND OF THE INVENTION

This invention relates to an openable casing for personal tabletop use, containing a stack of cards on which the user may list, alphabetically or otherwise, the names, addresses, telephone numbers and other pertinent data of persons and/or organizations with which he is associated. More specifically, the invention deals with improvements in such a tabletop directory casing containing a stack of tab-indexed cards and permitting the user to gain ready access to desired entries merely by selective manual depression of the tabs exposed on the front end of the casing.

In the tabletop directory casing of the type under consideration, it has been customary, as shown and described in Japanese Patent Publication No. 14175/1975, to support the stack of cards horizontally on a base structure, with the cards being normally enclosed in a pivotal top cover which is spring biased in the opening direction. Upon manual depression of any selected one of the tabs of the cards projecting forwardly out of the top cover, the card or cards overlying the card having the selected tab are turned upwardly with the top cover, as by being engaged by a pair of laterally spaced engaging levers mounted within the top cover adjacent its front end.

Since, however, the stack of cards is mounted horizontally on the base structure according to the prior art, as pointed out above, a desired spacing is often not formed between the front end portions of the depressed card and the one lying immediately thereover. As a consequence, the levers may fail to positively engage the card or cards to be raised with the top cover. Such defective operation is particularly liable to occur when a card at or near the bottom end of the stack is depressed, and is almost inevitable with cards which have been in use for an extended length of time or which have become damp as in rainy seasons.

SUMMARY OF THE INVENTION

It is an object of this invention to provide a tabletop directory casing having a stack of tabbed cards so supported therein that upon selective manual depression of any of the tabs, the corresponding desired page is unfailingly openable without the noted difficulties.

It is also an object of this invention to provide a tabletop directory casing wherein its top cover is of relatively small uniform thickness whereby its transportation and stocking are facilitated and damage thereof which might occure due to load imposed thereon can be prevented.

According to this invention, briefly summarized, there is provided a directory casing which comprises a base adapted to support on its top a stack of cards each having a tab projecting forwardly therefrom, said top of the base including a resiliently supported front end portion which is depressible by manual force exerted on any of the tabs of the cards thereon, a top cover pivotally coupled at its rear end to the base and adapted to be closed over the cards thereon so as to leave their tabs exposed, spring means biasing the top cover in an opening direction, engaging means for normally locking the top cover in a closed position against the bias of the spring means and, upon exertion of manual force on a selected one of the tabs, for permitting the top cover to open with the card or cards, if any, overlying the card having the selected tab, and stationary card-declining means provided on the top of the base and arranged rearwardly of the resiliently supported front end portion thereof to support the cards on the top of the base in rearwardly declining disposition, whereby upon exertion of manual force on a selected one of the tab, a sufficient spacing can be formed between the front end portions of the card having the selected tab and card lying immediately thereover.

The invention will be more fully understood from the following detailed description with reference to the accompanying drawings.

DETAILED DESCRIPTION

Figure 1:
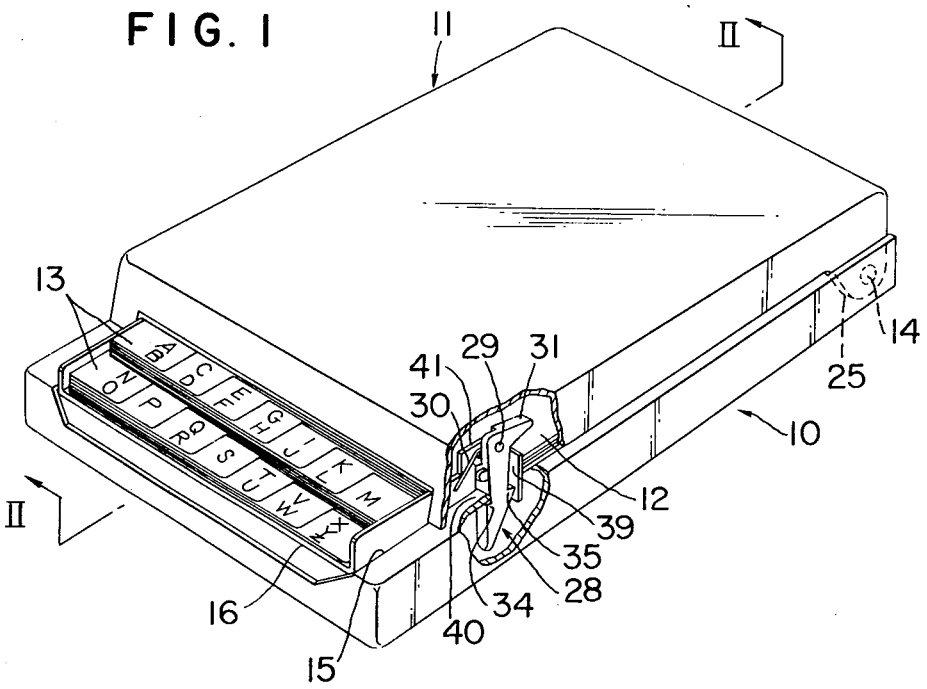
FIG. 1 is a perspective view, partly broken away, of the tabletop directory casing embodying the principles of this invention.
Figure 2:
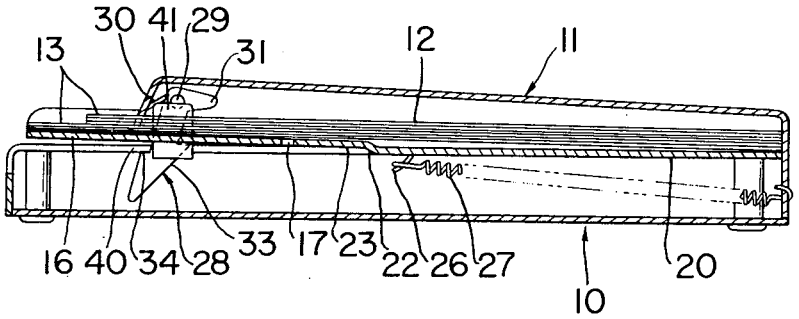
FIG. 2 is a vertical section taken along the line II—II of FIG. 1 as viewed in the arrow direction.

With reference to the drawings and initially to FIGS. 1 and 2 thereof, a preferred form of the tabletop directory casing according to this invention broadly comprises a boxlike base 10 and a top cover 11, which can be both molded of plastics or fashioned from sheet metal. The base 10 is adapted to support on its top a loose or unbound stack of tab-indexed cards 12 each having a tab 13 projecting forwardly therefrom, and the top cover 11 has its rear end pivotally connected at 14 to the base 10 so as to be closable and openable over the cards 12. It will be observed that when closed, the top cover 11 encloses all but the tabs of the cards.

Figure 3:
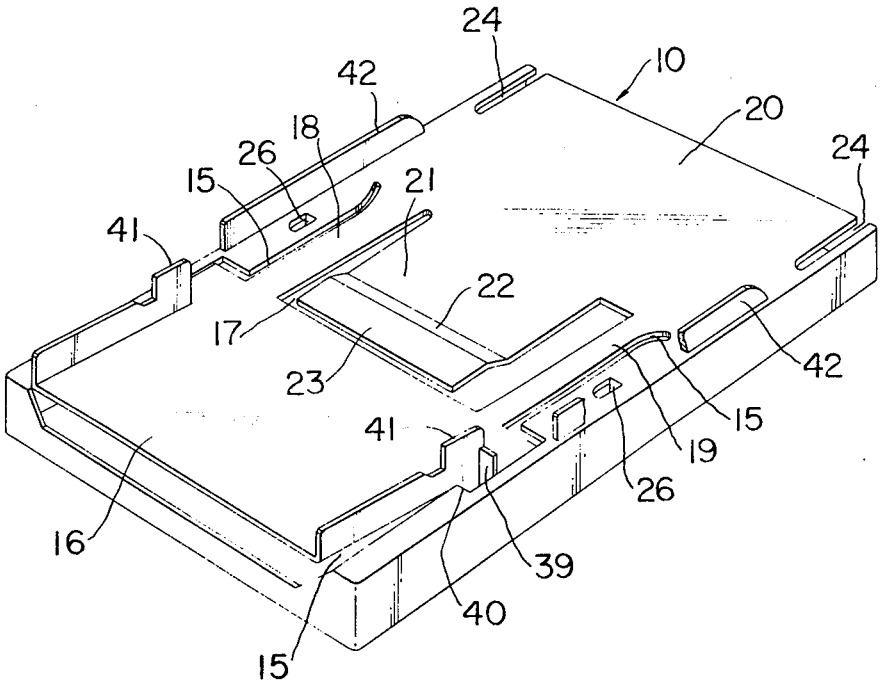
FIG. 3 is a perspective view, partly broken away of a base of the directory casing of FIGS. 1 and 2.

As best shown in FIG. 3, the top of the base 10 has a substantially U-shaped cut 15 therein defining a manually depressible front end portion 16, and another, smaller U-shaped cut 17 forming a pair of connective arms 18 and 19 extending rearwardly from the front end portion to a stationary rear end portion 20. It will therefore be seen that the front end portion 16 is resiliently supported by the rear end portion 20 via the connective arms 18 and 19, substantially in a cantilever fashion.

According to a feature of this invention, the stationary rear end portion 20 of the top of the base 10, inclusive of a tongue-like portion 21 between the connective arms 18 and 19, should generally decline rearwardly so that the stack of cards 12 will be supported thereon in rearwardly declining disposition. To this end, in this particular embodiment of the invention, the rear end portion 20 is stepped at 22 to provide a raised portion 23 immediately rearwardly of the resiliently supported front end portion 16.

A pair of laterally spaced slots 24 are formed in the top of the base 10 at its rear end to receive respective lugs 25 (FIG. 1) projecting downwardly from the top cover 11. These lugs 25 are pivotally connected as aforesaid to the base 10 at 14. The top of the base 10 also has a pair of laterally spaced hooks 26, and as illustrated in FIG. 2, a pair of coil springs 27 are tensioned respectively between these hooks and the lower part of the rear end of the top cover 11. The springs 27 are thus adapted to bias the top cover 11 in the opening direction.

With reference again to FIGS. 1 and 2, a pair of engaging levers 28 preferably made of plastics are arranged inside the top cover 11 adjacent its front end are each connected at its top end to the top cover 11 by means of a pin 29 for pivotal movement in the front-to-rear direction of the directory casing. These levers 28 are biased to pivot rearwardly, or counterclockwise as viewed in FIG. 2, by respective torsion springs 30.

Figure 4:
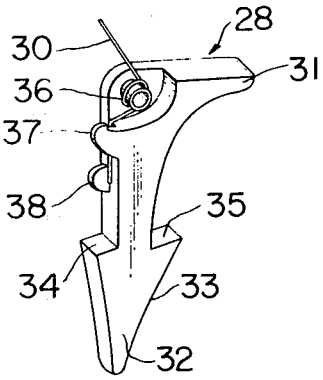
FIG. 4 is a perspective view on an enlarged scale of an engaging lever seen in FIG. 2.

As illustrated in greater detail in FIG. 4, each lever 28 has a limit stop 31 projecting rearwardly from its top end and adapted to abut the under surface of the cover 11 for limiting the rearward pivotal movement of the lever by the force of the spring 30. At its bottom end the lever 28 terminates in a tapered head 32 having a rearwardly facing guide edge 33. Just above the head 32 the lever has two ledges 34 and 35 located on its front and rear sides. The ledge 34 will hereinafter be referred to as the front ledge, and the ledge 35 as the rear ledge. A sleeve 36 formed integrally with and projecting laterally from the top end of each lever 28 slidably receives the pin 29, and the torsion spring 30 is coiled several turns around this sleeve 36. The torsion spring 30 has one of its ends engaged by projections 37 and 38 on the lever 28 and the other end urged into contact with the front end of the top cover 11 for biasing the lever in the counterclockwise direction.

As will be seen from FIGS. 1 through 3, the resiliently supported front end portion 16 of the top of the base 10 has a pair of upstanding abutments 39 formed integral therewith at its lateral edges. These butments 39, arranged rearwardly of the respective levers 28 substantially in confronting relationship thereto, are adapted to make abutting contact with the rear ledges 35 or the highest point of the guide edge 33 of the levers for holding same in the angular position of FIGS. 1 and 2 against the bias of the springs 30 while the top cover 11 is closed.

In opposed relationship to the respective abutments 39, and slightly spaced forwardly therefrom, a pair of short, transversely extending arresting edges 40 are formed by stationary portions of the top of the base 10 adjacent its lateral edges. The stationary edges 40 are in engagement with the front ledges 34 of the respective levers 28 when the top cover 11 is closed, so that the cover 11 can be locked in the closed position, as will be later explained in greater detail.

A pair of upturned guide walls 41 are formed integral with, and on both lateral edges of, the resiliently supported front end portion 16 of the top of the base 10, which guide walls 41 are opposed to each other and in right-angular relationship to the respective abutments 39. Made suitably higher than the abutments 39, the guide walls 41 are adapted, partly in cooperation with the respective abutments 39, to hold the stack of cards 12 in correctly aligned position on the top of the base 10 in spite of the repeated opening and closing operations of the top cover 11, as will be more fully apparent hereinbelow. Shown at 42 are a pair of side stops formed on stationary portions of the top of the base 10, the side stops coacting with the guide walls 41 to retain the cards in aligned position on the top of the base.

Figure 5:
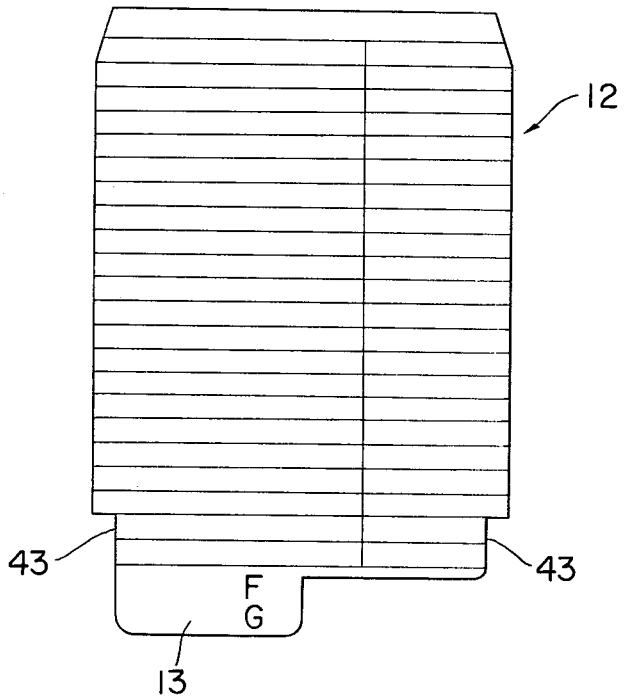
FIG. 5 is a plan view of one of cards for use in the directory casing according to the invention.

As clearly illustrated in FIG. 5, each card 12 for use with the directory casing according to the invention has the tab 13 carrying a character or characters thereon which represent the pages accessible by depression of the tab. The character or characters may be initial or initials of persons' names listed on each card 12. It will be seen by referring also to FIG. 1 that the tabs 13 of the successive cards are formed in progressively increasing length or transverse dimensions and, if required, in two or more different widths so that at least the character carrying portion of each tab will be left uncovered by the overlying tab or tabs when the cards are stacked up in the prescribed sequence.

Each card 12 has a pair of recesses 43 at its front corners. When a stack of such cards are placed in aligned position on the top of the base 10, each associated pair of abutment 39 and guide wall 41 neatly fit in the corresponding recesses 43 of the cards. These cards can therefore be restrained from displacement in both front-to-rear and lateral directions of the casing during the opening and closing of the top cover 11.

In operation, when the user desires to see some entry on a page identified by the tab marked S, for example, this particular tab is depressed by application of finger pressure to cause downward deflection of the corresponding card together with all the underlying cards and the resiliently supported front end portion 16 of the top of the base 10. Since the cards 12 are stacked on the base 10 generally in rearwardly declining disposition as aforesaid, a comparatively wide spacing can be formed between the front end portion of the card having the tab marked S and the overlying card having the tab marked QR. Without the raised portion 23 on the portion 20 of the base 10, the cards 12 would be stacked on the base in substantially horizontal disposition, so that only a small vertical spacing would be formed between the front end portion of the card having the tab marked S and the overlying card having the tab marked QR when the tab marked S is depressed, whereas, according to this invention, the rearwardly declining disposition of the cards provided by the raised portion 23 makes it possible to form a greater vertical spacing between the front end portion of the depressed card and the overlying card. This is advantageous as will become apparent below.

As the selected tab is depressed further, the abutments 39 are lowered accordingly in sliding contact with the respective levers 28, and as the sloping guide edges 33 of the levers ride over the tops of the abutments 39, the levers are gradually pivoted rearwardly under the influence of the springs 30, until at last their front ledges 34 move out of engagement with the stationary arresting edges 40 on the top of the base 10. Thereupon the rear ledges 35 of the levers engage the respective recessed front corners of the card having the tab marked QR, and this and all the other cards overlying the card having the tab marked S are then turned upwardly with the top cover 11 as the latter is opened by the force of the springs 27. It is to be noted that when the rear ledges 35 of the levers 28 engage the recessed front corners of the card immediately above the depressed card, comparatively wide vertical spacing formed between the two cards due to the raised portion 23 assures positive engagement with failure-proof reliability of the rear ledges 35 with the lowermost one of the cards to be turned upward. In conventional directory casings, the vertical spacing to be formed between a depressed card and the overlying card is not sufficient for the reason stated above, so that they lack failure-proof reliability.

With the desired page of the directory thus readily opened, the user may now look for the desired entry thereon.

When the top cover 11 is subsequently closed against the bias of the springs 27, the guide edges 33 of the levers 28 slide over the tops of the respective abutments 39. As the top cover 11 is further lowered onto the base 10, the levers 28 are slidingly pressed forwardly by the abutments 39 against the bias of the springs 30 until their front ledges 34 engage the under surface of the arresting edges 40. The top cover 11 is now locked in the closed position. Guided by the guide walls 41, as well as by the abutments 39, the cards that have been raised with the top cover smoothly return to their initial position over the remaining cards, practically without any possibility of displacement in any possible direction.

Figure 6:
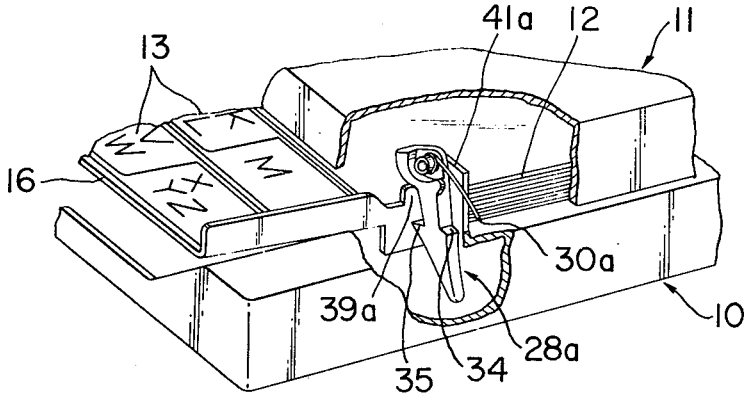
FIG. 6 is a fragmentary perspective view, partly broken away, of a modification of the directory casing shown in FIG. 1.

FIG. 6 illustrates a modification of the tabletop directory casing described above, in which each engaging lever **28*a*, identical in construction with the lever 28 shown in FIG. 4, is arranged for pivotal movement in the transverse direction of the casing. In conformity with such arrangement of the levers 28*a*, the abutment and guide wall on each lateral side of the resiliently supported front end portion 16 of the top of the base 10 are interchanged in position and are designated respectively by the reference characters 39*a* and 41*a* in FIG. 6. Other details of construction and operation are considered apparent from the foregoing description of FIGS. 1 through 5**.

In FIGS. 7 through 10, there is illustrated a second embodiment of the invention. In these figures, the same reference numerals as are used in the preceding figures indicate the same or identical parts and elements.

According to this second embodiment, a top cover 11 is pivotally secured to a base 10 by means of a pivot pin 46 (FIG. 8) and is urged to swing upward by means of a torsion spring **27*b*. As opposed to the first embodiment in which the vertical thickness of the cover 11 increases toward the front end, the cover 11 of the second embodiment has a uniform vertical thickness throughout its area as most clearly shown in FIG. 8**.

The reason why the thickness of the cover 11 is increased toward the front end in the first embodiment is that the cover 11 must accomodate in its front part the vertically oriented engaging levers 28. It is apparent that the greater thickness of the cover 11 at its front part causes inconvenience in stacking the directory casings for transporting or stocking purposes. Moreover, the irregular shape of the directory casing according to the first embodiment sometimes causes damage to the casing while a number of the casings are transported and handled in stacked condition.

The second embodiment of the invention as illustrated is free from the above stated disadvantages. The advantage of the second embodiment is realized by the provision of modified engaging levers **28*b*** which are slidable in the front-to rear direction of the directory casing.

Figure 10:
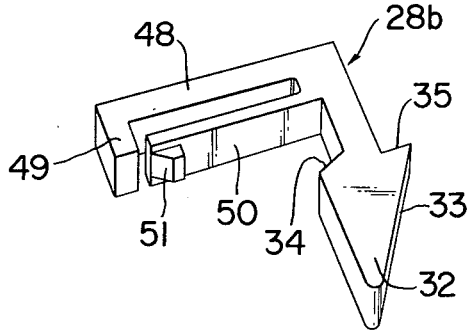
FIG. 10 is a perspective view on an enlarged scale of an engaging lever seen in FIGS. 7 and 8.

As most clearly shown in FIG. 10, each engaging lever **28*b*, made of a relatively resilient plastic, comprises a tapered head 32 having a rearwardly facing guide edge 33. Like the lever 28 shown in FIG. 4, the lever 28*b* has front and rear ledges 34 and 35 formed by the head 32. The front ledge 34 may be slightly slanted as shown. The lever 28*b* is formed with a forwardly extending first arm 48 having a downwardly projecting part 49. The lever 28*b* is also formed with a forwardly extending second arm 50 having an engagement lug 51. The arm 50** is made relatively thin so that it has a resiliency of a certain degree.

Figure 7:
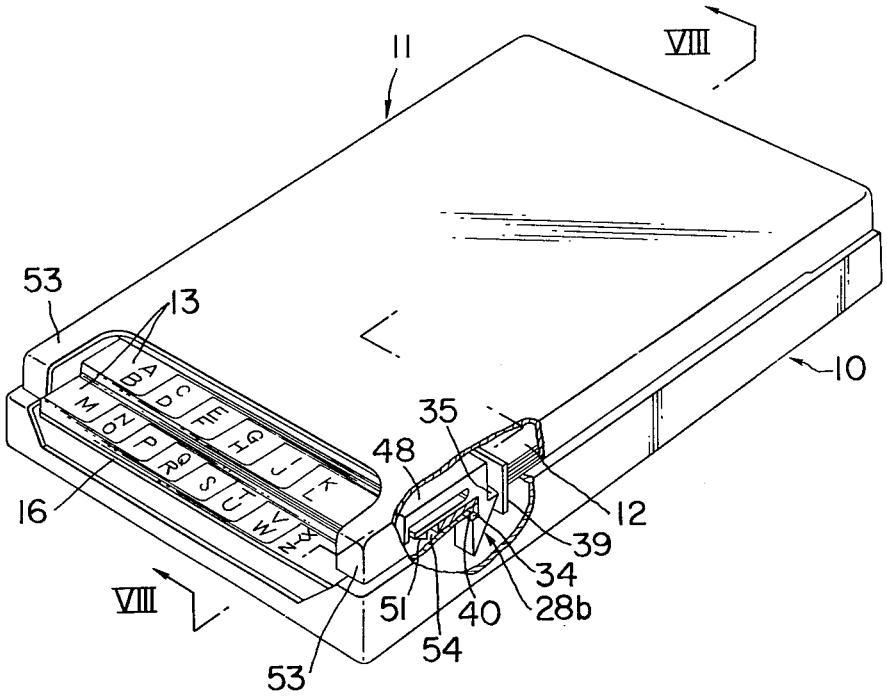
FIG. 7 is a perspective view, partly broken away, of a second embodiment of this invention.
Figure 8:
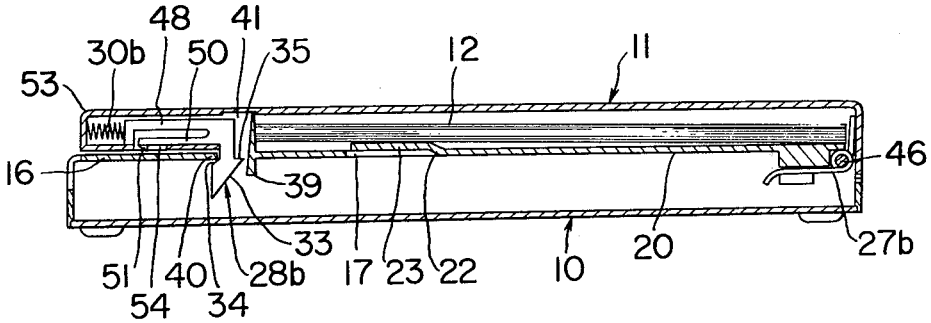
FIG. 8 is a vertical section taken along the line VIII—VIII of FIG. 7 as viewed in the arrow direction.
Figure 9:
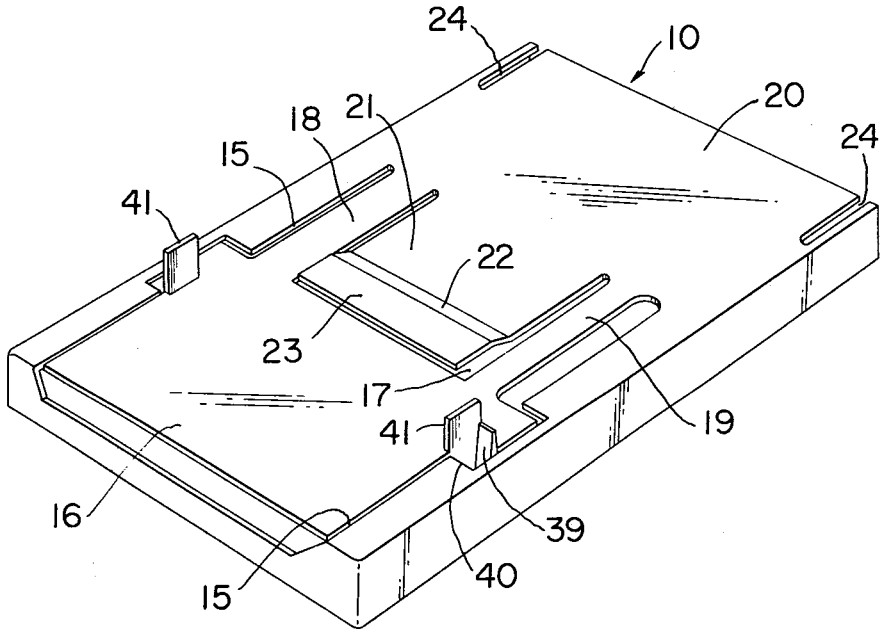
FIG. 9 is a perspective view of a base used in the second embodiment of the invention.

The engaging levers **28*b* are slidably held in the cover 11 as shown in FIGS. 7 and 8. More specifically, the cover 11 is integrally formed with a pair of hollow forward extensions 53 in each of which the lever 28*b* is held in a manner slidable forwardly and rearwardly. The arms 48 and 50 of each lever 28*b* fit snugly in the hollow interior of the forward extension 53. The bottom wall of each forward extension 53 is formed with an engagement aperture 54 in which the lug 51 of the lever 28*b* is in engagement. Between the forward end wall of the forward extension 53 and the part 49 of the lever 28*b* is interposed a compression spring 30*b* which urges the engaging lever 28*b* until the engagement lug 51 of the lever abuts against the rear end of the engagement aperture 54. In the closed condition of the directory casing, however, rearward movement of the lever 28*b* is prevented by an abutment 39 formed on the base 10, so that the lug 51 is not in abutment with the rear end of the aperture 54**.

In this embodiment of the invention, the base 10 is slightly different from the base 10 shown in FIG. 3. First, the base 10 lacks the hooks 26 and the side stops 42 shown in FIG. 3, as will be observed from FIG. 9. Second, the guide walls 41 are far shorter than the guide walls 41 shown in FIG. 3.

The operation of the second embodiment is substantially the same as that of the first embodiment of the invention except that the engaging levers **28*b* make sliding movement in place of pivotal movement. It will be readily understood that when a desired card is depressed, the abutments 39 are lowered while maintaining sliding contact with the respective levers 28*b*, and after the sloping guide edges 33 of the levers ride over the tops of the abutments 39, the levers 28*b* are allowed to gradually slide rearwardly under the force of the springs 30*b*, with the result that the front ledges 34 are moved out of engagement with the arresting edges 40**.

Figure 11:
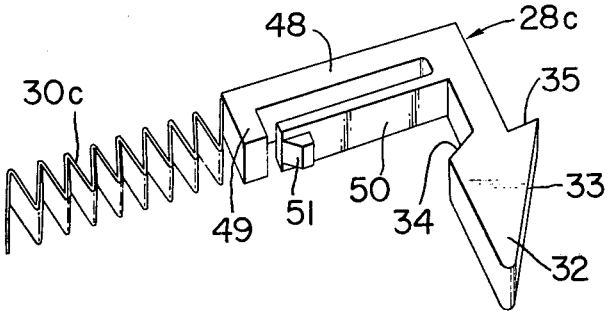
FIG. 11 is a perspective view of an enlarged scale of a modified engaging lever.

FIG. 11 shows a modified form of the engaging lever **28*b*. According to the modified form, an engaging lever 28*c* and a spring 30*c* corresponding to the compression spring 39*b* are combined into a single element. The spring 30*c* is a strip of a zigzag shape and is molded integrally with the lever 28*c***. It is preferable that the element be made of a relatively resilient plastic.

Figure 12:
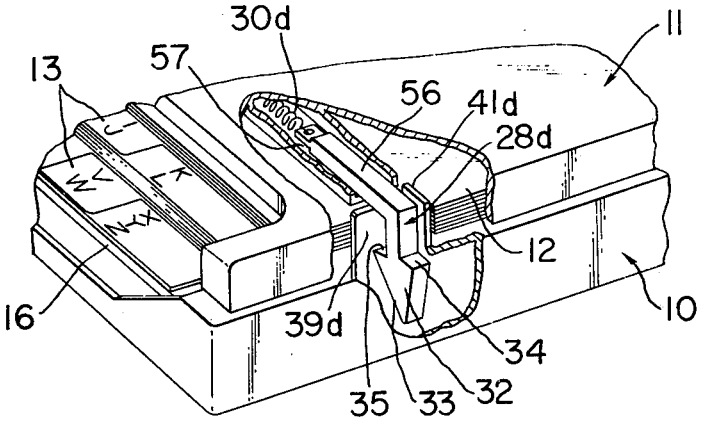
FIG. 12 is a fragmentary perspective view, partly broken away, of a modification of the directory casing shown in FIG. 7.

In FIG. 12 is shown a modification of the tabletop directory casing illustrated in FIGS. 7 through 10. According to this modification, an engaging lever **28*d* at each side of the directory casing is slidable in the transverse direction thereof. In conformity with such arrangement of the lever 28***d*, the abutment and guide wall on each lateral side are interchanged in position and are designated respectively by the reference characters 39*d* and 41*d*.

Figure 13:
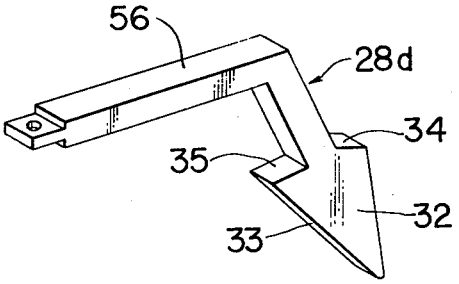
FIG. 13 is a perspective view on an enlarged scale of an engaging lever used in the directory casing shown in FIG. 12.

The lever 28*d* is formed with a guide arm 56 as shown in FIG. 13, and this guide arm 56 is slidably received in a transverse guide slot 57 provided under the cover 11. A tension spring 30*d* is provided to urge the lever 28*d* transversely inwardly, whereby the ledge 35 of the lever 28*d* is in engagement with the abutment 39*d* which acts on the guide edge 33 when lowered in connection with depression of any card tab 13. The ledge 34 of the lever 28*d* is normally in engagement with a stationary arresting edge (not shown) of the base 10.

While the invention has been described in terms of its specific embodiments illustrated in the accompanying drawings, it is not desired to limit the invention to the exact details disclosed. For example, the lever 28, 28*a*, 28*b*, 28*c* or 28*d* may be provided only on one lateral side of the top cover 11. Further, where two such levers are provided on both sides of the cover as in the illustrated embodiments, the ledge 34 of one lever, preferably left hand lever may be dispensed with. If, however, the ledge 34 is removed from the left hand lever, for example, then the right hand connective arm 19 may be made suitably smaller in width than the left hand arm 18. This is because, should the two arms be of equal width, the right hand side of the resiliently supported front end portion 16 might not be sufficiently deflected to cause the right hand lever to pivot out of engagement with the corresponding stationary edge 40 upon exertion of finger pressure on some tab located on the left hand side of the casing.

I claim:

1. A directory casing comprising a base adapted to support on its top a stack of cards each having a tab projecting forwardly therefrom, said top of the base including a resiliently supported front end portion which is depressible by manual force exerted on any of the tabs of the cards thereon, a top cover pivotally coupled at its rear end to the base and adapted to be closed over the cards thereon so as to leave their tabs exposed, spring means biasing the top cover in an opening direction, engaging means for normally locking the top cover in a closed position against the bias of the spring means and, upon exertion of manual force on a selected one of the tabs, for permitting the top cover to open with the card or cards, if any, overlying the card having the selected tab, and stationary card-declining means provided on the top of the base and arranged rearwardly of the resiliently supported front end portion thereof to support the cards on the top of the base in rearwardly declining disposition, whereby upon exertion of manual force on a selected one of the tabs, a sufficient spacing can be formed between the front end portions of the card having the selected tab and the card lying immediately thereover.

2. The directory casing as claimed in claim 1 wherein said card-declining means comprises a raised portion provided rearwardly of the resiliently supported front end portion.

3. The directory casing as claimed in claim 2 wherein said raised portion is connected to a rearwardly continuing part of the base through a stepped portion.

4. The directory casing as claimed in claim 2 wherein said base comprises a stationary rear end portion, and said resiliently supported front end portion of the base is connected to the stationary rear end portion through a pair of spaced apart connective arms, and wherein a tongue-like portion extends from the stationary rear end portion toward the resiliently supported front end portion and between said connective arms, and said raised portion is provided on the free end of said tongue-like portion.

5. The directory casing as claimed in claim 1, further including guide wall means provided on the base to correctly align the stack of cards placed on the base.

6. The directory casing as claimed in claim 1 wherein said engaging means comprises an engaging lever supported by the top cover on at least one lateral side of the directory casing in a manner displaceable in a direction substantially along the top cover, said engaging lever having on one side thereof a tapered guide edge and a card-lifting ledge formed on the highest point of the guide edge and on the other side thereof an engagement ledge, an abutment provided on said resiliently supported front end portion of the base in opposed relation to said tapered guide edge and being in association with said depression of the front end portion, spring means urging the engaging lever against the abutment to keep the highest point of the tapered guide edge in engagement with the abutment, and a stationary arresting edge provided on the base and being normally in engagement with said engagement ledge to prevent the lever and hence the top cover from moving away from the base, said tapered guide edge of the lever being shaped to be displaced away from the stationary arresting edge in response to co-action with said base to thereby disengage ledge from the arresting edge.

7. The directory casing as claimed in claim 6 wherein said engaging lever is pivotally supported by the top cover in a manner swingable in a front-to-rear direction.

8. The directory casing as claimed in claim 6 wherein said engaging lever is pivotally supported by the top cover in a manner swingable in a direction transverse to a front-to-rear direction.

9. The directory casing as claimed in claim 6 wherein said engaging lever is supported by the top cover in a manner slidable linearly relative to the same in a front-to-rear direction.

10. The directory casing as claimed in claim 9 wherein said engaging lever is slidably received in a hollow extension projecting forwardly from the top cover.

11. The directory casing as claimed in claim 6 wherein said engaging lever is supported by the top cover in a manner slidable linearly relative to the same in a direction transverse to a front-to-rear direction.

* * * * *